US005339473A

United States Patent [19]

Crist

[11] Patent Number: 5,339,473

[45] Date of Patent: Aug. 23, 1994

[54] TAPPING CHIP EXTRACTOR TOOL

[76] Inventor: Timothy M. Crist, 1071 Ogden-Parma T.L. Rd., Spencerport, N.Y. 14559

[21] Appl. No.: 27,436

[22] Filed: Mar. 8, 1993

[51] Int. Cl.[5] ..... B25F 1/00

[52] U.S. Cl. ..... 7/170; 7/901; 81/488; 294/65.5

[58] Field of Search ..... 7/170, 901; 81/53.2, 81/8.1, 488; 72/705; 294/65.5

[56] References Cited

U.S. PATENT DOCUMENTS 300,317 6/1884 Griffith ..... 81/901
2,417,762 3/1947 Koller ..... 7/901
3,263,533 8/1966 Carlson ..... 81/53.2
3,952,618 4/1976 Seamon ..... 81/53.2
4,034,594 7/1977 Morgan ..... 72/705
4,078,458 3/1978 Berendzen ..... 81/53.2

*Primary Examiner*—Roscoe V. Parker
*Attorney, Agent, or Firm*—E. Michael Combs

[57] ABSTRACT

A tool includes an elongate shank having an extractor threaded screw member, including a barbed projection extending therefrom to secure chips within a priorly tapped blind bore. The barbed tip is of magnetic material to enhance securement of chips relative to the barbed projection.

3 Claims, 4 Drawing Sheets

FIG. 3
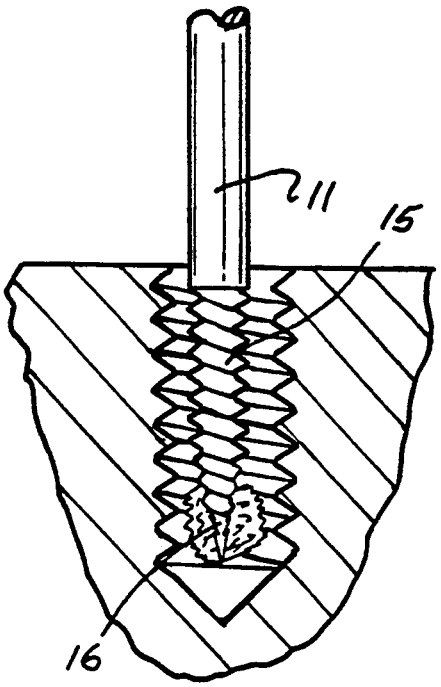
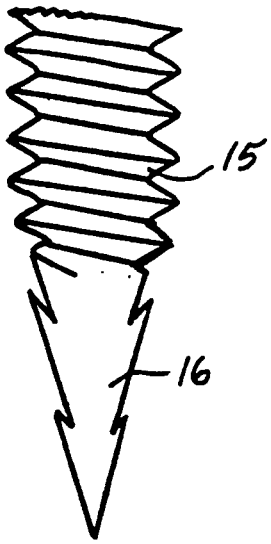
FIG. 4

FIG. 5
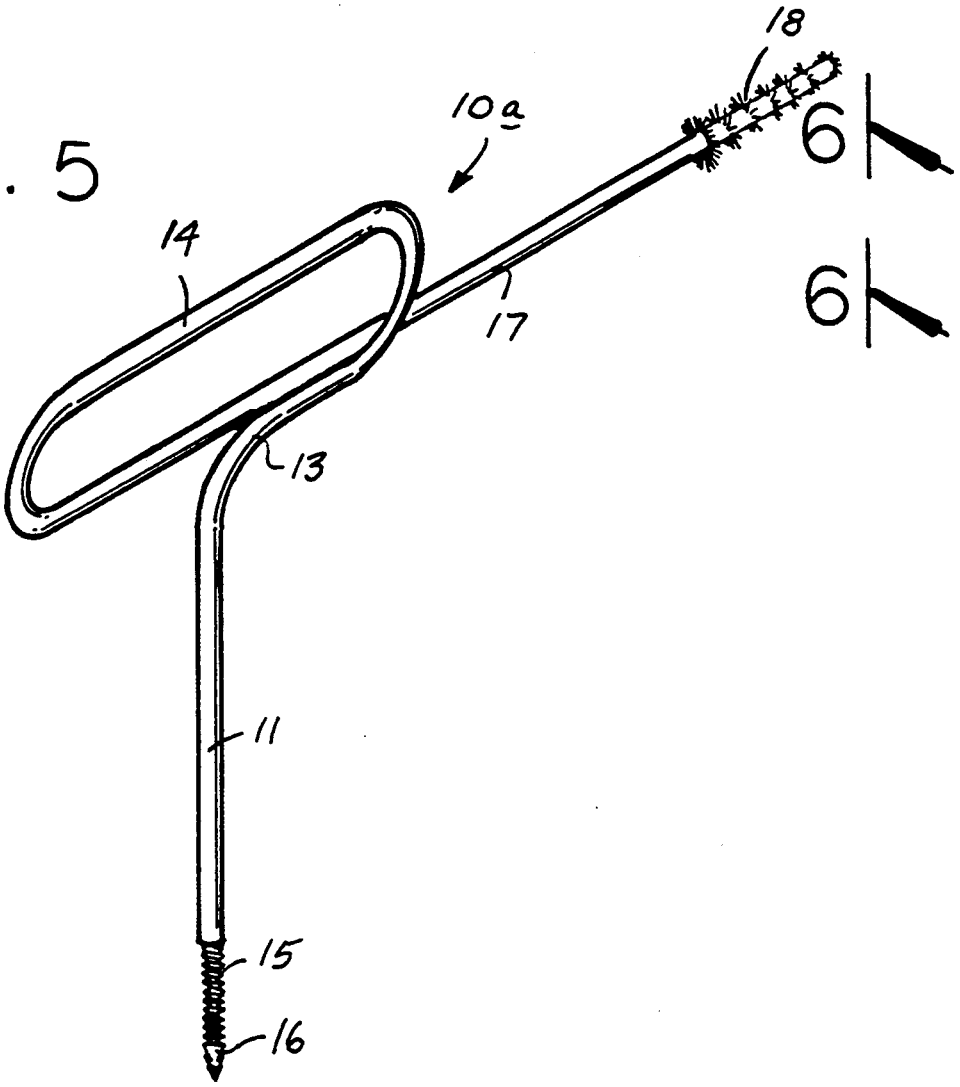
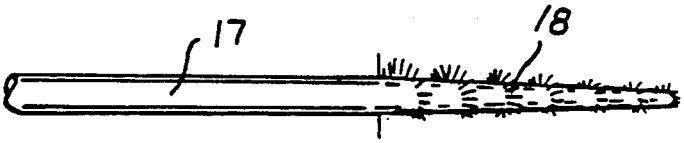
FIG. 6

TAPPING CHIP EXTRACTOR TOOL

BACKGROUND OF THE INVENTION

1. Field of the Invention

The field of invention relates to tapping tool structure, and more particularly pertains to a new and improved tapping chip extractor tool arranged to remove metal chips relative to a tapped bore.

2. Description of the Prior Art

Removal of metallic chips relative to a tapped bore is frequently difficult in that in blind bores that are tapped removal of the chips in the utilization of pneumatic pressure for example adds to the undesirable decibel noise level within a working environment, wherein the instant invention utilizes a helically cut thread mounted to a lowermost end of an elongate shank to permit engaging of chips within the bore and in this respect, the present invention substantially fulfills this need.

SUMMARY OF THE INVENTION

In view of the foregoing disadvantages inherent in the known types of tapping tool structure now present in the prior art, the present invention provides a tapping chip extractor tool wherein the same is arranged to remove metallic particles relative to a tapped bore. As such, the general purpose of the present invention, which will be described subsequently in greater detail, is to provide a new and improved tapping chip extractor tool which has all the advantages of the prior art tapping tool structure and none of the disadvantages.

To attain this, the present invention provides a tool including an elongate shank having an extractor threaded screw member, including a barbed projection extending therefrom to secure chips within a priorly tapped blind bore. The barbed tip is of magnetic material to enhance securement of chips relative to the barbed projection.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tapping chip extractor tool which has all the advantages of the prior art tapping tool structure and none of the disadvantages.

It is another object of the present invention to provide a new and improved tapping chip extractor tool which may be easily and efficiently manufactured and marketed.

It is a further object of the present invention to provide a new and improved tapping chip extractor tool which is of a durable and reliable construction.

An even further object of the present invention is to provide a new and improved tapping chip extractor tool which is susceptible of a low cost of manufacture with regard to both materials and labor, and which accordingly is then susceptible of low prices of sale to the consuming public, thereby making such tapping chip extractor tools economically available to the buying public.

Still yet another object of the present invention is to provide a new and improved tapping chip extractor tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged orthographic view of the tool operative within an associated blind bore.

FIG.4 is an enlarged orthographic view of the tip portion of the invention.

FIG. 5 is an isometric illustration of a modified aspect of the invention.

FIG. 6 is an orthographic view, taken along the lines 6—6 of FIG. 5 in the direction indicated by the arrows.

DESCRIPTION OF THE PREFERRED EMBODIMENT

Figure 1:
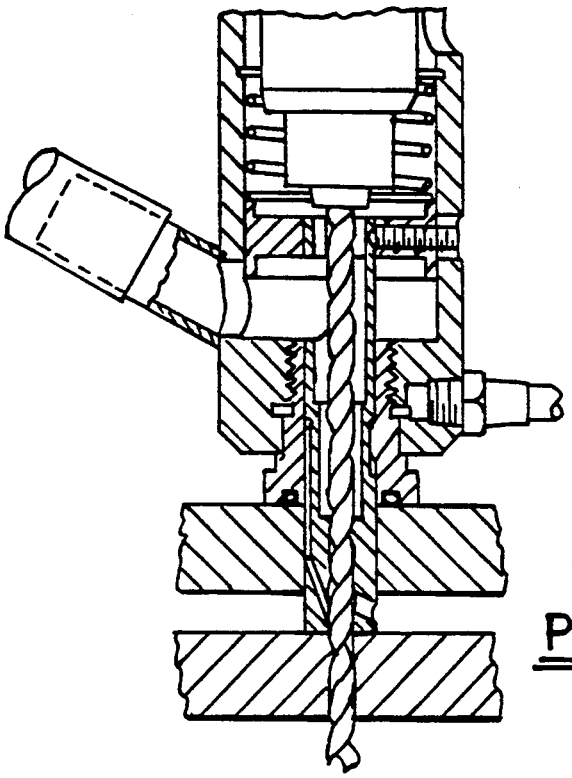
FIG. 1 PRIOR ART
FIG. 1 is an orthographic cross-sectional illustration of a prior art chip extraction apparatus employing a vacuum source to remove chips relative to a bore. Further, lubricant and/or pressurized air directed into the bore of the workpiece is provided by the structure, as indicated in U.S. Pat. No. 5,033,917 to McClasson, et al.

With reference now to the drawings, and in particular to FIGS. 1 to 8 thereof, a new and improved tapping chip extractor tool embodying the principles and concepts of the present invention and generally designated by the reference numerals 10, 10*a*, and 10*b* will be described.

Figure 2:
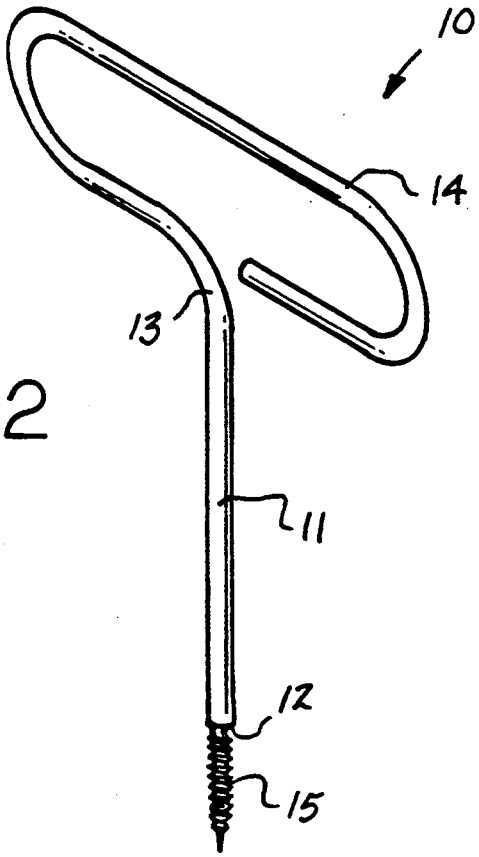
FIG. 2 is an isometric illustration of the invention.

More specifically, the tapping chip extractor tool 10 of the instant invention, as indicated in FIG. 2, includes an elongate tool shank 11 longitudinally aligned, having a first end 12 spaced from a second end 13, with the second end 13 having a handle loop 14 extending orthogonally relative to the tool shank 11, with the tool shank first end 12 including an extractor screw 15 integral with the first end 12 and coaxially aligned therewith. An extractor screw barbed magnetic pointed projection 16 extends longitudinally aligned relative to the extractor screw 15 for securing chip members, as indicated in FIG. 3. The extractor screw 15 is of a helically wound configuration terminating at the projection 16. In this manner, chip members upon continuous rotation of the shank 11 are removed from the associated bore, as indicated in FIG. 3.

The tool 10*a*, as indicated in FIG. 5, includes a handle projecting rod 17 directed from the handle loop 14 adjacent the shank second end 13, with the projecting rod 17 orthogonally oriented relative to the shank 11 extending therefrom. The projecting rod 17 terminates in a wire brush 18 for enhanced cleaning, with the wire brush of a generally conical configuration, as illustrated in FIG. 6.

Figure 7:
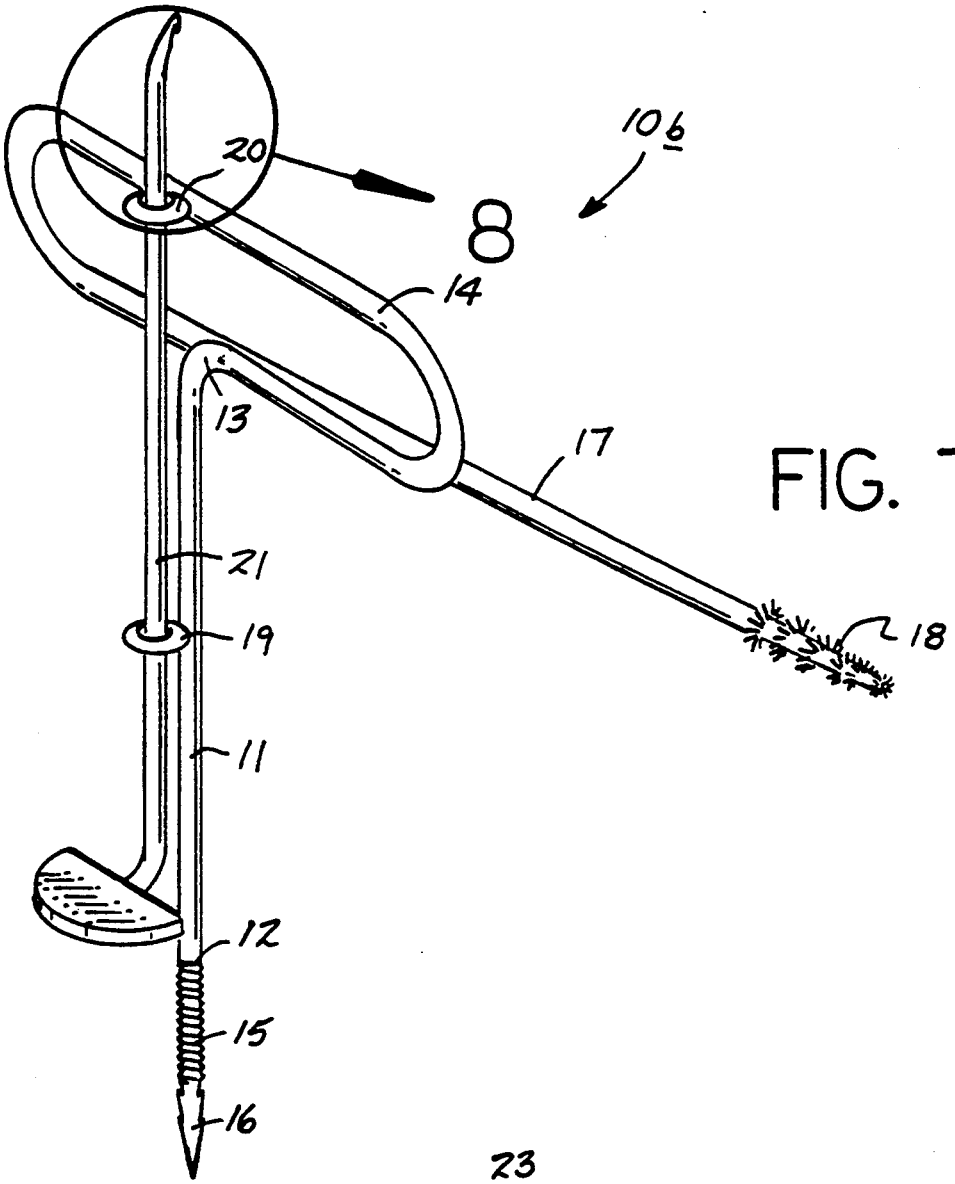
FIG. 7 is an isometric illustration of a further modified aspect of the invention.
Figure 8:
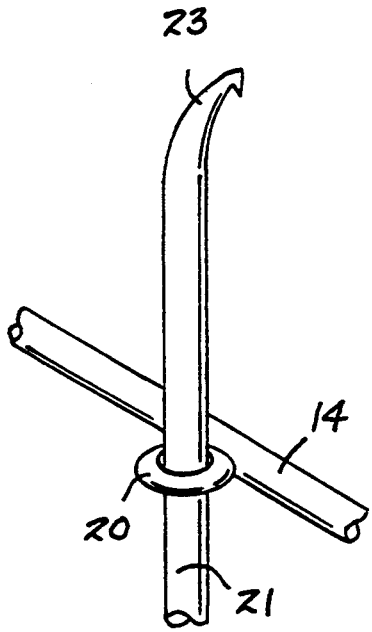
FIG. 8 is an enlarged isometric illustration of section 8 as set forth in FIG. 7.

The tool 10*b*, as indicated in the FIGS. 7 and 8, further includes respective first and second guide loops 19 and 20 that are coaxially aligned mounted to the respective shank 11 and handle loop 14. A guide rod 21 is slidably directed through the guide loops 19 and 20 in a parallel relationship relative to the shank 11, with an abutment plate 22 fixedly and orthogonally mounted to the guide rod first end, with the guide rod second end terminating in a barbed hook 23 arranged for projecting beyond the handle loop 14, with the barbed hook 23 formed of a magnetic material to enhance engagement and extraction of particles within the tapped bore of FIG. 3.

As to the manner of usage and operation of the instant invention, the same should be apparent from the above disclosure, and accordingly no further discussion relative to the manner usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tapping chip extractor tool, comprising, an elongate longitudinally aligned tool shank, having a shank first end spaced from a shank second end, the shank first end having a helically wound extractor screw integrally mounted to the second end coaxially aligned therewith, and a handle loop extending orthogonally relative to the tool shank fixedly mounted to the tool shank second end, and the extractor screw includes a barbed magnetic pointed projection extending longitudinally aligned relative to the extractor screw projecting therefrom for enhanced engagement of a tapping chip within a tapped bore.

2. A tool as set forth in claim 1 wherein the handle includes a projecting rod, the projecting rod orthogonally oriented relative to the tool shank, and the projecting rod extending from the handle in adjacency to the shank second end, with the projecting rod terminating in a wire brush of a conical configuration for reception with the tapped bore.

3. A tool as set forth in claim 2 including a first guide loop mounted to the tool shank and a second guide loop mounted to the handle loop, with the first guide loop and the second guide loop arranged in a coaxially aligned relationship, and a guide rod slidably received through the first guide loop and the second guide loop in a parallel relationship relative to the tool shank, the guide rod having a guide rod first end and a guide rod second end, the guide rod first end including an abutment plate for engagement with the first guide loop, and the guide rod second end having a barbed hook formed of magnetic material extending from the guide rod second end.

* * * * *